US011107619B2

(12) United States Patent
Kim et al.

(10) Patent No.: US 11,107,619 B2
(45) Date of Patent: Aug. 31, 2021

(54) INDUCTOR

(71) Applicant: SAMSUNG ELECTRO-MECHANICS CO., LTD., Suwon-Si (KR)

(72) Inventors: Young Sun Kim, Suwon-si (KR); Jin Soo Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 383 days.

(21) Appl. No.: 16/002,898

(22) Filed: Jun. 7, 2018

(65) Prior Publication Data

US 2019/0189332 A1 Jun. 20, 2019

(30) Foreign Application Priority Data

Dec. 15, 2017 (KR) ..... 10-2017-0172925

(51) Int. Cl.

| | |
|---|---|
| ***H01F 27/28*** | (2006.01) |
| ***H01F 27/32*** | (2006.01) |
| ***H01F 27/29*** | (2006.01) |
| ***H01F 17/04*** | (2006.01) |
| ***H01F 17/00*** | (2006.01) |

(52) U.S. Cl.

CPC ..... *H01F 27/2804* (2013.01); *H01F 17/0013* (2013.01); *H01F 17/04* (2013.01); *H01F 27/29* (2013.01); *H01F 27/292* (2013.01); *H01F 27/323* (2013.01); *H01F 2017/048* (2013.01); *H01F 2027/2809* (2013.01)

(58) Field of Classification Search

CPC ..... H01F 27/2804; H01F 2027/2809; H01F 27/323; H01F 27/292; H01F 27/29

USPC ..... 336/200, 232

See application file for complete search history.

(56) References Cited

U.S. PATENT DOCUMENTS

| | | | | |
|---|---|---|---|---|
| 2004/0240106 | A1* | 12/2004 | Iitsuka | G11B 5/3103 360/123.46 |
| 2009/0096364 | A1 | 4/2009 | Fujii et al. | |
| 2014/0247102 | A1* | 9/2014 | Kurobe | H01F 5/003 336/200 |
| 2015/0035634 | A1* | 2/2015 | Nakamura | H01F 41/046 336/170 |

FOREIGN PATENT DOCUMENTS

| | | | | |
|---|---|---|---|---|
| JP | 5271657 | B2 | 8/2013 | |
| JP | 2015037179 | A * | 2/2015 | C25D 5/022 |
| KR | 10-1999-0066108 | A | 8/1999 | |
| KR | 10-2016-0140390 | A | 12/2016 | |
| KR | 20160140390 | A * | 12/2016 | |

* cited by examiner

*Primary Examiner* — Tszfung J Chan

(74) *Attorney, Agent, or Firm* — Morgan, Lewis & Bockius LLP

(57) ABSTRACT

An inductor includes: a body including a coil portion; and an external electrode disposed on an external surface of the body, wherein the coil portion includes an insulator having an opening and a coil pattern filling the opening, and a maximum thickness of the coil pattern is greater than a thickness of the insulator in contact with a side surface of the coil pattern.

11 Claims, 2 Drawing Sheets

INDUCTOR

CROSS-REFERENCE TO RELATED APPLICATION(S)

This application claims the benefit of priority to Korean Patent Application No. 10-2017-0172925, filed on Dec. 15, 2017 in the Korean Intellectual Property Office, the disclosure of which is incorporated herein by reference in its entirety.

BACKGROUND

1. Field

The present disclosure relates to an inductor, and more particularly, to a high-inductance power inductor.

2. Description of Related Art

In accordance with the development of information technology (IT), apparatuses have been rapidly miniaturized and thinned. Therefore, a market demand for small thin devices has increased.

In accordance with such a technical trend, Korean Patent Laid-Open Publication No. 10-1999-0066108 provides a power inductor including a substrate having a via hole and coils disposed on opposite surfaces of the substrate and electrically connected to each other through the via hole of the substrate to attempt to provide an inductor including coils having a uniform and large aspect ratio.

SUMMARY

An aspect of the present disclosure may provide an inductor having improved Rdc characteristics and reliability.

According to an aspect of the present disclosure, an inductor includes: a body including a coil portion; and an external electrode disposed on an external surface of the body. The coil portion may include an insulator having an opening and a coil pattern filling the opening, and a maximum thickness of the coil pattern is greater than a thickness of the insulator in contact with a side surface of the coil pattern.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, an inductor according to an exemplary embodiment in the present disclosure will be described. However, the present disclosure is not necessarily limited thereto.

Figure 1:
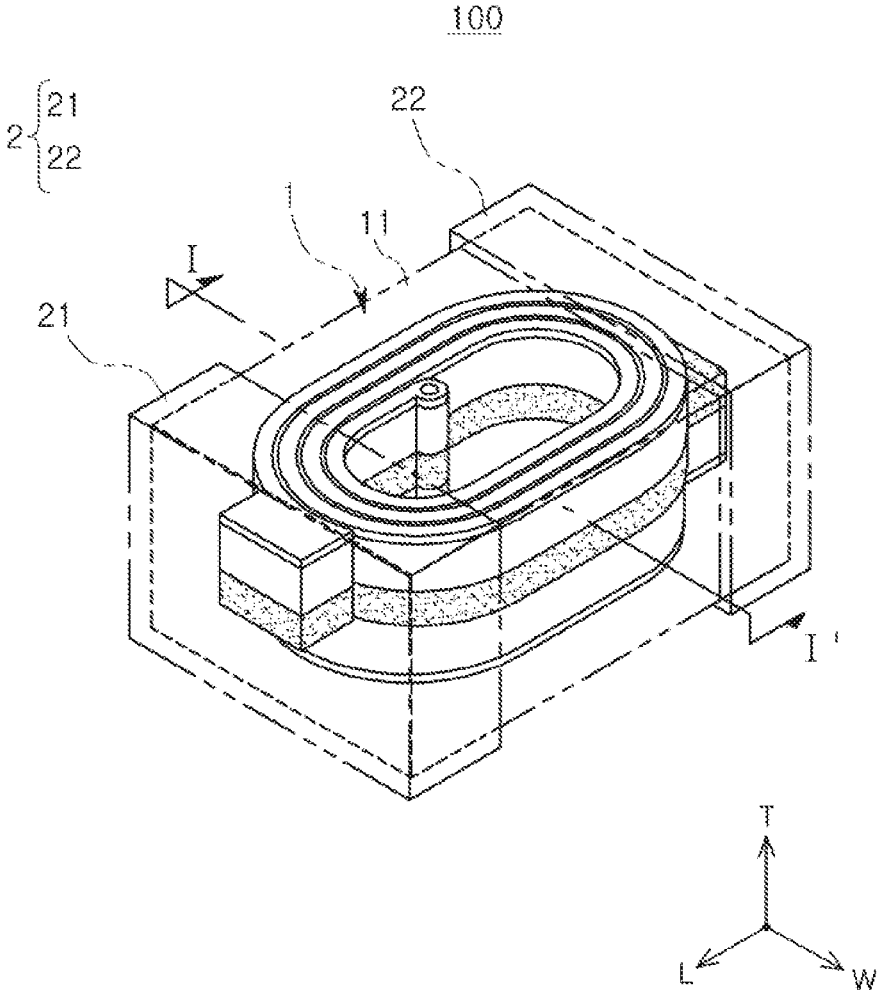
FIG. 1 is a perspective view illustrating an inductor according to an exemplary embodiment in the present disclosure.
Figure 2:
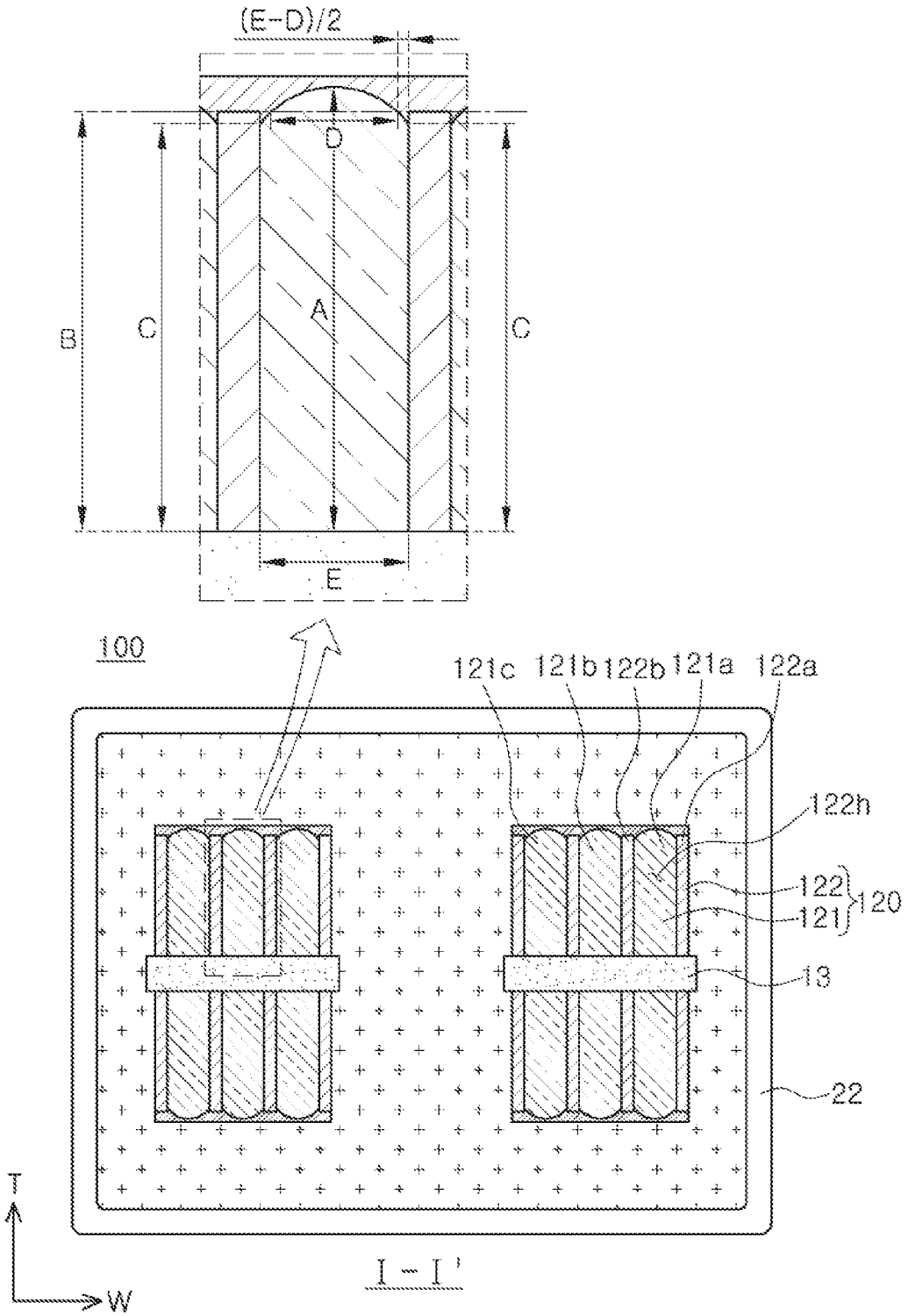
FIG. 2 is a cross-sectional view taken along line I-I' of FIG. 1.

FIG. 1 is a perspective view illustrating an inductor according to an exemplary embodiment in the present disclosure, and FIG. 2 is a cross-sectional view taken along line I-I' of FIG. 1.

Referring to FIGS. 1 and 2, an inductor 100 may include a body 1 including a coil and an external electrode 2 disposed on an external surface of the body. In this case, the external electrode 2 may include a first external electrode 21 and a second external electrode 22 disposed on external surfaces of the body to be spaced apart from each other and functioning as different polarities.

The body 1 may form an appearance of the inductor, and may have upper and lower surfaces opposing each other in a thickness direction T, first and second end surfaces opposing each other in a length direction L, and first and second side surfaces opposing each other in a width direction W to thus have a substantially hexahedral shape.

The body 1 may include a magnetic material 11. The magnetic material may be any material having a magnetic property. In this case, the magnetic material may include metal magnetic particles or ferrite based magnetic particles, and may have a form in which the metal magnetic particles or the ferrite based magnetic particles are dispersed in a resin.

A coil portion 120 may be encapsulated by the magnetic material 11. The coil portion 120 may include an internal coil 121 including a plurality of coil patterns and an insulator 122 insulating the plurality of coil patterns in the internal coil from each other and including a plurality of partition walls. The coil portion 120 may be supported by a support member 13. In some cases, the support member may be ultimately removed by a detach process after the internal coil is formed. The support member 13 may include a material having an insulation property and having rigidity enough to appropriately support the internal coil and the insulator, and may include an insulating resin or an insulating magnetic material having an insulation property. In detail, the support member may be any known copper clad laminate (CCL) substrate, an insulation thin plate in which an inorganic filler or a glass is impregnated in an insulating resin, a photoimagable dielectric (PID) resin, an Ajinomoto build-up film (ABF), or the like, but is not limited thereto.

The insulator 122 in the coil portion may be configured to insulate side surfaces of adjacent coil patterns from each other, and may serve as a guide of plating growth of the coil patterns. In general, when plating growth in a thickness direction is enhanced in order to increase an aspect ratio of the coil patterns, shapes of the coil patterns may not be uniform, and a risk that a plating deviation between the coil patterns will occur may be high. However, when predetermined opening patterns are prepared in advance from an insulating resin utilizing the insulator 122 and plating growth of the coil patterns in openings of the opening patterns is performed, the plating growth of the coil patterns may be stably performed. The insulator 122 may include opening patterns **122*h*. The opening patterns 122*h* may have a shape corresponding to that of the desired coil pattern. For example, the opening patterns 122*h*** may have a spiral shape of which circular cross sections having different radii of curvature are repeated plural times, but is not limited thereto.

The insulator 122 may include a permanent type of photosensitive insulating material such as a bisphenol-based epoxy resin. The bisphenol-based epoxy resin may be, for example, a bisphenol A novolak epoxy resin, a bisphenol A diglycidyl ether bisphenol A polymer resin, or the like, but is not limited thereto. That is, the insulator 122 may include a permanent type of general resist material.

A manner of forming the opening pattern in the insulator may be appropriately selected by those skilled in the art, but may be, for example, a patterning manner through exposure and development when a photosensitive insulating material is included in the insulator. In this case, the insulator may be laminated as a single layer on the support member, and may then be patterned. Alternatively, a plurality of insulating sheets may be laminated on the support member and may then be patterned collectively.

As an aspect ratio of the insulator is increased, turns of the coil pattern in a limited size of the inductor may be increased, and an aspect ratio of the coil pattern may be increased. However, as the aspect ratio of the insulator is increased, the insulator may not be supported on the support member, and the possibility that collapse or delamination of the insulator will occur may be increased. When the collapse, or the like, of the insulator occurs as described above, the possibility that a short-circuit between adjacent coil patterns will occur or a plating deviation between the coil patterns will occur may be increased. Therefore, the present disclosure may provide a technical unit capable of increasing an aspect ratio of the coil pattern, which may, for example, improve Rdc characteristics of the inductor, in addition to a method of increasing the thickness of the insulator.

Referring to FIG. 2, the internal coil 121 may include a plurality of coil patterns 121*a*, 121*b*, and 121*c*. Opposite side surfaces of a coil pattern 121*a* of the plurality of coil patterns may be in contact with side surfaces of first and second insulators 122*a* and 122*b*, respectively. Here, a term 'contact' conceptually includes a case in which the coil pattern is in contact with the insulator in an inclined state, in addition to a physical or chemical contact.

A maximum thickness A of the coil pattern 121*a* may be greater than a thickness B of each of the first and second insulators 122*a* and 122*b* adjacent to the coil pattern 121*a*. When the coil pattern is filled in the opening of the insulator, a thickness of the insulator may be greater than a target thickness, that is, a maximum thickness, of the coil pattern. However, as described above, when the thickness of the insulator is increased, the possibility that the collapse or the delamination of the insulator will occur may be significantly increased, and there may thus be a limitation in increasing the thickness of the insulator.

In the inductor according to the present disclosure, the thickness of each of the first and second insulators may be smaller than the maximum thickness of the coil pattern to improve stability of the insulator.

When the maximum thickness of the coil pattern 121*a* is greater than the thickness of each of the first and second insulators adjacent to the coil pattern 121*a*, a height C of a portion of the coil pattern 121*a* in contact with the first insulator and a height C of a portion of the coil pattern 121*a* in contact with the second insulator need to be lower than the thickness of each of the first and second insulators. Here, the coil pattern may be in contact with the first and second insulators at a height that is substantially the same as that of each of the first and second insulators. A point of the coil pattern having the maximum thickness may coincide with a central line between the first and second insulators, which means that the coil pattern is formed in a horizontal symmetrical state in the opening of the insulator. When the coil pattern is formed in the horizontal symmetrical state in the opening of the insulator, a side effect such as a decrease in withstand voltage characteristics, or the like, may be effectively prevented.

Since the coil pattern 121*a* has the maximum thickness at the center thereof as described above, an upper surface of the coil pattern may have a convex shape in a direction that becomes distant from the support member.

In addition, when the coil pattern 121*a* passes through the same plane as upper surfaces of the first and second insulators, a line width of the coil pattern at that point may be D. The line width may be smaller than a maximum line width E of the coil patterns, which is a width between the first and second insulators.

Meanwhile, the following Table 1 represents Rdc defective rates and short-circuit defective rates depending on ratios of the maximum thickness A of the coil pattern to the thickness B of the insulator (for reference, a superscript * in Table 1 indicates Comparative Example of Experimental Examples).

TABLE 1

| no | A/B | Rdc Defective Rate | Short-circuit Defective Rate |
|---|---|---|---|
| 1 * | 0.91 | 2.36 | 1.23 |
| 2 * | 0.92 | 2.01 | 0.56 |
| 3 * | 0.95 | 1.18 | 0 |
| 4 * | 0.95 | 0.95 | 0 |
| 5 * | 0.99 | 0.25 | 0 |
| 6 | 1.01 | 0.01 | 0.01 |
| 7 | 1.02 | 0 | 0 |
| 8 | 1.02 | 0.01 | 0.01 |
| 9 | 1.06 | 0 | 0 |
| 10 | 1.07 | 0 | 0 |
| 11 | 1.09 | 0.01 | 0 |
| 12 | 1.09 | 0 | 0 |
| 13 | 1.11 | 0 | 0.01 |
| 14 | 1.11 | 0 | 0.02 |
| 15 | 1.12 | 0 | 0.01 |
| 16 | 1.13 | 0 | 0 |
| 17 | 1.13 | 0.01 | 0 |
| 18 | 1.14 | 0 | 0 |
| 19 | 1.14 | 0 | 0.01 |
| 20 | 1.14 | 0 | 0.01 |
| 21 | 1.15 | 0 | 0 |
| 22 * | 1.17 | 0 | 0.15 |
| 23 * | 1.17 | 0 | 0.36 |
| 24 * | 1.19 | 0 | 1.11 |
| 25 * | 1.19 | 0 | 1.02 |
| 26 * | 1.2 | 0 | 1.58 |
| 27 * | 1.21 | 0.01 | 1.99 |
| 28 * | 1.25 | 0 | 3.12 |
| 29 * | 1.26 | 0 | 2.56 |
| 30 * | 1.28 | 0 | 3.31 |

As seen from the above Table 1, an Rdc defective rate is significantly decreased from Experimental Example No. 6 in which the ratio of the maximum thickness A of the coil pattern to the thickness B of the insulator is 1.01. This means that when the ratio (A/B) is smaller than 1.01, the maximum thickness of the coil pattern is small, and it is thus difficult to implement demanded Rdc characteristics. On the other hand, when the ratio (A/B) is 1.10 or more, the maximum thickness of the coil pattern is increased, such that it is easy to implement demanded Rdc characteristics, and an Rdc defective rate is thus hardly within an effective range.

However, it may be seen that a short-circuit is significantly increased from Experimental Example No. 21, which means that as the maximum thickness of the coil pattern is increased, it becomes significantly difficult to control occurrence of a short-circuit between the coil pattern and another coil pattern adjacent to the coil pattern. When the ratio (A/B) is 1.15 or less, the short-circuit does not substantially occur, but when the ratio (A/B) exceeds 1.15, the short-circuit occurs. Therefore, the ratio (A/B) may not exceed 1.15.

The following Table 2 represents characteristics of the inductor depending on a relationship between the maximum line width E of the coil pattern and the line width D of the coil pattern at that point when the coil pattern passes through the same plane as the upper surfaces of the first and second insulators in a case in which the maximum thickness of the coil pattern is greater than a thickness of each of adjacent insulators and a height of the coil pattern in contact with each of the insulators is lower than a thickness of each of the insulators.

TABLE 2

| no | D/(E − D) | Rdc 불량율 |
|---|---|---|
| 1* | 0.32 | 1.56 |
| 2* | 0.45 | 1.29 |
| 3* | 0.50 | 1.19 |
| 4* | 0.55 | 1.20 |
| 5* | 0.58 | 0.99 |
| 6* | 0.60 | 0.76 |
| 7* | 0.77 | 0.66 |
| 8* | 0.91 | 0.69 |
| 9* | 0.91 | 0.36 |
| 10 | 0.95 | 0 |
| 11 | 1.02 | 0.01 |
| 12 | 1.25 | 0 |
| 13 | 1.89 | 0 |
| 14 | 2.06 | 0 |
| 15 | 2.10 | 0 |
| 16 | 2.10 | 0 |
| 17 | 3.55 | 0.01 |
| 18 | 3.60 | 0 |
| 19 | 4.12 | 0 |
| 20 | 6.89 | 0 |

For reference, a superscript * in Table 2 indicates Comparative Example of Experimental Examples.

Referring to Table 2, when the coil pattern passes through the same plane as the upper surface of the insulator, in a case in which the line width D of the coil pattern at that point is greater than or equal to (0.95/1.95)×E, where E is the maximum line width of the coil pattern, an Rdc defective rate may be significantly decreased. Here, the space between the insulator and the coil pattern in the length direction on the same plane as the upper surface of the insulator may be filled with an insulating layer or a magnetic material. The insulating layer may constitute a double insulating layer together with the insulator to enhance an insulation property between the coil portion and the magnetic material. The insulating layer may include a material different from that of the insulator to be thus distinguished from the insulator. For example, the insulating layer may be an ABF or an insulating resin coating layer, but is not limited thereto. In addition, the magnetic material may encapsulate the coil portion, and extend up to a through-hole of the support member to serve to increase magnetic permeability of the inductor.

In Experimental Example 10 of Table 2, D may be (0.95/1.95)×E, where E is the maximum line width of the coil pattern. In this case, an Rdc defective rate may be 0. On the other hand, it may be seen that in Experimental Examples 1* to 9*, Experimental Examples in which D is smaller than (0.95/1.95)×E, Rdc defective rates are within an effective range. This means that since the line width of the insulator at the same height as that of the insulator is smaller than (0.95/1.95) times the width of the space between the insulator and the coil pattern at that point, even though the maximum thickness of the coil pattern is greater than the height of the insulator, a surface area is too small to derive an effective level of Rdc characteristics.

Therefore, in a case in which the maximum thickness of the coil pattern is greater than the thickness of the insulator, when the coil pattern passes through the same plane as the upper surface of the insulator, the line width D of the coil pattern at that point may be (0.95/1.95) times or more the width E of the space between the insulator and the coil pattern in the length direction on the same plane as the upper surface of the insulator.

According to the inductor described above, the Rdc defective rate may be significantly decreased, and a reliability problem occurring due to the short-circuit between adjacent coil patterns may be effectively removed, as compared to an inductor including an insulator having a limited thickness due to collapse or delamination of the insulator in a process of developing or plating the insulator.

As set forth above, according to the exemplary embodiments, an inductor of which Rdc characteristics are decreased and in which a reliability problem of a short-circuit is solved within an effective range may be provided.

While exemplary embodiments have been shown and described above, it will be apparent to those skilled in the art that modifications and variations could be made without departing from the scope of the present invention as defined by the appended claims.

What is claimed is:

1. An inductor comprising:

a body including a coil portion; and an external electrode disposed on an external surface of the body, wherein the coil portion includes an insulator having an opening and a coil pattern filling the opening, a maximum thickness of the coil pattern is greater than a thickness of the insulator, the insulator being in contact with a side surface of the coil pattern, and an interface between the coil pattern and the insulator is free of a surface parallel to a lower surface of the coil pattern.

2. The inductor of claim 1, wherein an upper surface of the coil pattern has a convex shape.

3. The inductor of claim 1, wherein a maximum line width of the coil pattern is the same as a width of the opening.

4. The inductor of claim 1, wherein a ratio of the maximum thickness of the coil pattern to the thickness of the insulator in contact with the side surface of the coil pattern is 1.15 or less, and the ratio is greater than 1.

5. The inductor of claim 1, wherein a line width of the coil pattern on the same plane as an upper surface of the insulator is smaller than a width of the opening.

6. The inductor of claim 1, wherein a line width of the coil pattern on the same plane as an upper surface of the insulator is (0.95/1.95) times or more the width of the opening.

7. The inductor of claim 6, wherein on a level below the upper surface of the insulator, a magnetic material or an insulating layer is disposed in the space between the insulator and the coil pattern.

8. The inductor of claim 7, wherein the insulating layer includes a material different from that of the insulator.

9. The inductor of claim 1, wherein a thickness of the coil pattern extending from a side surface of the insulator in contact with the coil pattern is smaller than that of the insulator.

10. The inductor of claim 1, wherein a point of the coil pattern having the maximum thickness is collinear with a center of the opening.

11. The inductor of claim 1, wherein the opening includes a plurality of openings and the coil pattern includes a plurality of coil patterns, and each of the plurality of coil patterns fills a respective each of the plurality of openings.

* * * * *